United States Patent [19]

Durchschlag et al.

[11] Patent Number: 4,927,102

[45] Date of Patent: May 22, 1990

[54] REVERSING DEVICE FOR MOVABLE PARTS WITHIN THE DEFLECTION AREA OF A RAILWAY SWITCH

[75] Inventors: Gerald Durchschlag, Zeltweg; Alfred Lang, Wiesen; Franz Rotter, Zeltweg; Dieter Fritz, Fohnsdorf; Heinz Kopilovitsch, Hetzendorf, all of Austria

[73] Assignee: Voest-Alpine Maschinenbau Gesellschaft m.b.H., Linz, Austria

[21] Appl. No.: 267,876

[22] Filed: Nov. 7, 1988

[30] Foreign Application Priority Data

Nov. 5, 1987 [AT] Austria ..... 2931/87
Sep. 16, 1988 [AT] Austria ..... 2274/88

[51] Int. Cl.[5] ..... E01B 7/02; E01B 7/16

[52] U.S. Cl. ..... 246/469; 246/435 R; 246/448; 246/452

[58] Field of Search ..... 246/388, 415 R, 435 R, 246/438, 442, 443, 448, 449, 452, 454, 468, 469, 472, 430; 104/130

[56] References Cited

U.S. PATENT DOCUMENTS

| | | | |
|---|---|---|---|
| Re. 29,353 | 8/1977 | Metcalf | 246/388 |
| 528,776 | 11/1894 | Horrie | 246/275 |
| 770,614 | 9/1904 | St. George-Moore | 246/415 R |
| 1,269,444 | 6/1918 | Hollingshed | 246/469 |
| 1,371,937 | 3/1921 | Scartsaris | 246/435 R |

FOREIGN PATENT DOCUMENTS

| | | | |
|---|---|---|---|
| 328488 | 10/1975 | Austria . | |
| 0021848 | of 1891 | United Kingdom | 246/375 |

*Primary Examiner*—Andres Kashnikow
*Assistant Examiner*—Timothy Newholm
*Attorney, Agent, or Firm*—Cushman, Darby & Cushman

[57] ABSTRACT

In a reversing device for movable parts of a railway switch within the deflection area of a railway switch, in particular tongue rails, monorail deflection device or movable stock rails, in which device the movable rails can be caused to contact rigid switch parts, the movable rails are supported in their contacting position by supporting rods extending in the longitudinal direction of the rail the supporting rods are slideably guided on the sleepers or, respectively, base plates in the longitudinal direction of the rails. In this case, the supporting rods are designed as adjusting members for the reversing operation and comprise thrust supports cooperating with thrust supports of the movable rails for shifting the rails. At least one of the mutually cooperating surfaces of the thrust supports of rail and/or of supporting rod is formed of a wedge surface passing over into a supporting surface extending in an essentially parallel relation to the longitudinal direction of the supporting rod. The supporting surface cooperates in the contacting position of the rail with the thrust support of the rail. This provides in a simple manner the possibility to reliably and exactly effect reversing operation for railway switches, in particular high speed switches having a great radius of curvature.

12 Claims, 5 Drawing Sheets

REVERSING DEVICE FOR MOVABLE PARTS WITHIN THE DEFLECTION AREA OF A RAILWAY SWITCH

BACKGROUND OF THE INVENTION

1. Field of the Invention

The invention refers to a reversing device for movable parts of a railway switch within the deflection area of a railway switch, in particular tongue rails, monorail deflection devices or movable stock rails, in which device the movable rails can be caused to contact rigid switch parts.

2. Description of the Prior Art

In a known construction having become known from AT-PS 328488 for supporting the wing rails, switch reversal was performed in the usual manner and a push rod extending in the shifting direction of the parts to be shifted- was connected with the respective parts to be shifted. From U.S. Pat. No. 1,269,444 there is already known an arrangement, in which movable rail parts adapted for being alternately brought in contact with a frog, are adjusted by wedges acting on the webs of the rails between rigid abutments on the sleepers. In such arrangements, the shifting drive means must articulatedly act on the wedges, because the wedges must be kept in contact on the rail web. Exact guiding of the adjusting mechanisms is not easily possible in such an arrangement and, above all, a defined end position can not easily be warranted. In the known arrangement, the wedges must be swivelled together with the movable rails and during such swivelling movement there result, on account of the geometry of the linking connection, length variations in the driving connection. The known arrangement thus appears to not afford the required safety for railway tracks being travelled upon with high speed.

For the purpose of adjusting movable parts of a railway switch within the deflection area of a switch, in particular for adjusting tongue rails, there were, up untill now, developed several switch drive means becoming effective in the direction of the shifting movement of the tongue rails. The just assumed end position was locked by means or corresponding locking means. A known example for such locking means is the so called clamp tongue lock.

It is in particular in case of switches to be travelled upon with high speed and having great radii of curvature that there result a number of problems not resolved up untill now when attempting a correct adjustment with such usual switch drive means. For example, adjustment of the switch at only one location by means of such a usual switch drive means is, as a rule, not sufficient for such high speed switches when attempting to maintain the desired great radius of curvature within a longer area and to warrant the capability for travelling with high speed. Multiplying conventional switch drive means for tongue rails results, however, in a number of calibration problems, because the corresponding drive means associated to the same tongue rail in the longitudinal direction thereof must be operated under conditions maintaining the required radius of curvature.

SUMMARY OF THE INVENTION

The invention now aims at providing a reversing device, of the initially mentioned type for the movable parts of a railway switch within the deflection area of a switch, in particular for the tongue rails or movable stock rails, and in particular for switches being passed with high speed, by means of which device it is in a simple manner possible to exactly maintain the desired radius of curvature during the reversing operation and to simultaneously warrant a reliable track gauge. The reversing device is in particular intended to reduce the expenditure being caused by a plurality locking means of usual construction and to substantially reduce the number of required drive means, and this in particular in case of a correspondingly long shiftably supported area of the tongue rails as required for obtaining great radii of curvature. For solving this task, the invention essentially consists in that the movable rails are supported in their contacting position by supporting rods extending in longitudinal direction of the rail and being slideably guided on the sleepers or, respectively, base plates in longitudinal direction of the rails and in that the supporting rods are designed as adjusting members for the reversing operation and comprise thrust supports cooperating with thrust supports of the movable rails for shifting the rails. At least one of the mutually cooperating surfaces of the thrust supports of rail and/or supporting rod is formed of a wedge surface passing over into a supporting surface extending essentially in parallel relation to the longitudinal direction of the supporting rod, which supporting surface cooperates in the contacting position of the rail with the thrust support of the rail. On account of supporting the supporting rods on the sleepers or, respectively, on the base plates, there is reliably obtained an exact guiding action for these supporting rods and, on account of the arrangement of thrust supports on the supporting rod and, respectively, on the movable rail, it is simultaneously possible to obtain an adjusting drive means which causes in its respective end position a protection of the movable rails against horizontal forces. Simultaneously with such protection against horizontal forces acting in particular in switches being travelled upon with high speed, reversing operation may, by selecting the surfaces of the thrust supports coming just in mutual active connection, be effected such that the reversing operation is effected at a plurality of partial areas located adjacent one beside the other in longitudinal direction of the movable rails, thereby maintaining the required great radius of curvature, so that the capability of being travelled upon with high speed is reliably obtained. The supporting effect obtained in the end position is reliably established by the essentially parallel supporting surfaces becoming effective in the end position. After running up onto the supporting surfaces extending essentially in parallel relation to the longitudinal direction of the rails and adjoining the inclined surfaces, there is reliably obtained a defined adjusting path for reversing the movable rails, even if there occur, for example on account of temperature fluctuations, changes of the length in the supporting rod or the movable rail. These length variations on account of temperature fluctuations are of particular importance on account of the shiftable partial area, extending over a great length of the rail, of the tongue rail of a high speed switch.

For the purpose of reducing the friction losses on the thrust supports, the arrangement can advantageously be such that one of both mutually cooperating thrust supports comprises a roller. The wedge surfaces themselves may be formed of plane wedge surfaces, noting that it is, of course, easily conceiveable to design the wedge surfaces as arcuated surfaces, in particular as concavely arcuated surfaces.

In particular on account of the great radii of curvature in high speed switches and on account of the fact that the slideably guided partial area of the movable rails is of corresponding great length in case of such great radii of curvature, the arrangement is advantageously such that thrust supports, arranged in longitudinal direction, of the supporting rod or rods and/or of the movable rail parts have different height and/or inclination of the wedge surfaces. In case of utilizing usual switch adjusting drive means, there would be required for such arrangements for high speed switches three or even four switch drive means of usual construction, of which the tuning and the mutually dependent control would result in a substantially greater expenditure. The control could, in case of temperature fluctuations, simultaneously only act with a corresponding play on tongue rails.

The arrangement is preferably selected such that each supporting rod and each rail comprises at least three thrust supports, so that longer movable rail sections can be shifted for an exactly defined extent and the desired radius of curvature can exactly be adjusted. The rails themselves can, in a usual manner, be connected one with the other by track rods, so that shifting of one movable rail in direction of engaging a rigid switch part simultaneously results in shifting the opposite movable rail with maintainance of a predetermined distance from the respective opposite rigid switch part. In principle, there can be provided separate track rods for each movable rail. Driving operation must be effected in a phase-shifted manner such that for the purpose of shifting one rail into contact with a rigid switch part, the opposite rail to be just lifted off the rigid switch path must first be released from its locked position.

The arrangement can, however, also be, according to the invention, realized in a simple manner such that thrust supports are arranged at both sides of a supporting rod and have their supporting surfaces extending in an essentially parallel relation to the longitudinal direction of the supporting rod staggered in longitudinal direction of the supporting rod. By means of such an arrangement it becomes possible to move with only one supporting rod one movable rail in a position contacting a rigid switch part and to simultaneously lift a opposite movable rail off the rigid switch part, for which purpose the arrangement can, for example, be selected in a particularly simple manner such that the thrust supports act on coupling members of mutually associated movable rails. The arrangement can, however, also be selected such that the thrust supports connected with a supporting rod comprise cranked ledges extending in a transverse relation to the longitudinal axis of the supporting rod and have their flanks facing the thrust support and, being averted therefrom, cooperating with at least one counterstop, in particular a roller, of the thrust support of the rail. Also, such an arrangement provides the possibility to effect with only one supporting rod the simultaneous reversal of two movable rails in such a manner that one respective rail comes into contact with a rigid switch part and the respective other rail is lifted off from such rigid switch parts out of such an engaging position.

In addition to the supporting surfaces, extending in an essentially longitudinal direction of the rail, of the thrust support, there can be obtained an additional supporting effect by arranging between the thrust supports of a supporting rod and/or of a rail stop members for supporting the movable rail in contact with rigid rail parts, which stop members are disengaged when shifting the supporting rods in the longitudinal direction thereof. The shifting path of the movable rails is given free.

The safety means and control means for the position control may, in a simple manner, be designed such that the supporting rods are connected with means for sensing the position of the supporting rods, for example with electromagnetic end position transmitters or inductive proximity switches.

The procedure is, according to the invention, preferably such that the supporting rod or rods is (are) slideably guided within guide means, for example angle sections, being connected with the sleepers or, respectively, base plates and extending in the longitudinal direction of the rails. The angle sections can advantageously be welded to base plates. Such angle sections serve beside for supporting and guiding the supporting rods also for receiving additional transverse forces.

For the purpose of reducing the sliding friction in particular in case of long supporting rods apparently required in switch drive means designed for extremely great radii of curvature and for the purpose to keep small the size of the drive means, the arrangement is, according to the invention, advantageously selected such that the supporting rod or rods is (are) supported in the guide means in a manner sliding over rollers and/or in a resilient manner. Such a resilient supporting means makes, in particular sure that in case of poorly packed tracks and thus non-aligned upper edges of the sleepers, the supporting rods are reliably guided also over great length extensions.

BRIEF DESCRIPTION OF THE DRAWING

In the following, the invention is further explained with reference to examples of embodiment schematically shown in the drawings. In the drawings.

DETAILED DESCRIPTION OF THE PREFERRED EMBODIMENTS

Figure 1:
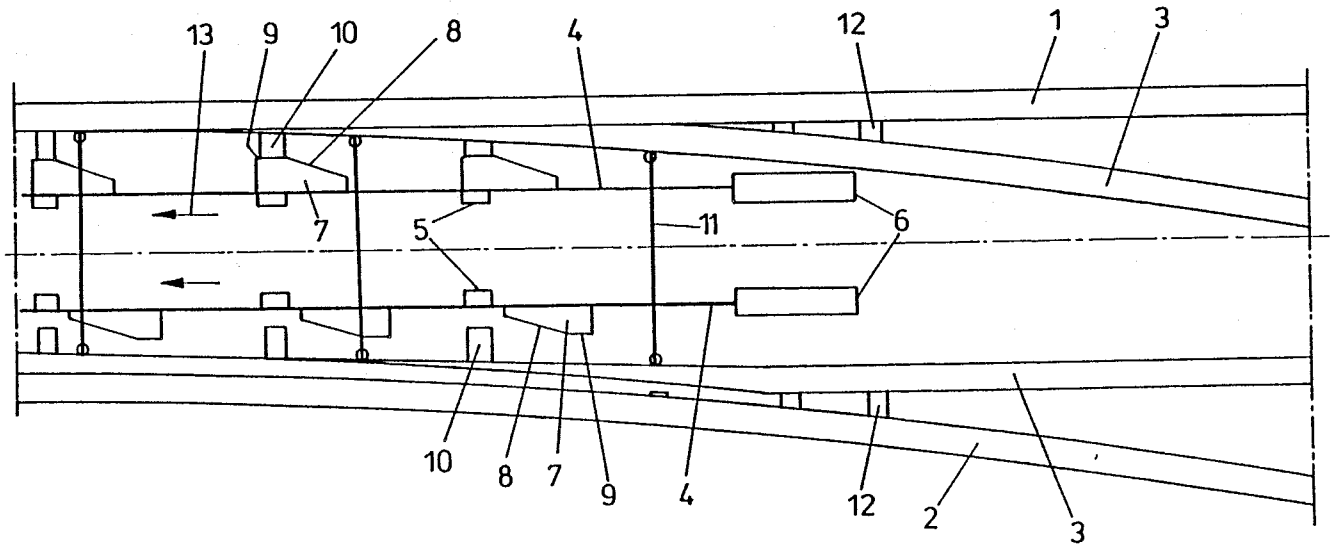
FIG. 1 shows a reversing device, according to the invention, for the movable tongue rails of a railway switch.

In FIG. 1 there are designated by the reference numerals 1 and 2 rigid stock rails fixedly mounted by being screwed to sleepers with interposition of base plates or the like, and there are designated by the reference numeral 3 movable tongue rails. For the purpose of reversing and supporting the tongue rails 3, there are provided supporting rods 4 being arranged in longitudinal direction of the straight-lined stock rail 1 and being guided in guide means 5 being, for example, mounted on sleepers. For actuating the supporting rods 4 in the sense of reversing the tongue rails, there are provided drive means 6, which may, for example, be formed of electric lifting motors or hydraulic cylinders. For the purpose of reversing and supporting the tongue rails, the supporting rods 4 comprise thrust supports 7 each comprising a wedge surface 8 passing over into a supporting surface 9 extending in essentially parallel relation to the longitudinal direction of the supporting rods 4. The thrust supports 7 cooperate with their wedge surfaces 8 and, respectively, with their supporting surfaces 9 extending in essentially parallel relation to the supporting rods 4 with thrust supports 10 provided on the tongue rails 3. The tongue rails are connected one with the other via track rods 11 being schematically indicated. In FIG. 1 there are further indicated tongue supports 12 between the stock rails 1, and respectively, 2 and the tongue rails 3.

In the arrangement shown in FIG. 1, both supporting rods 4 are actuated in the same directions by the drive means 6, noting that, for the purpose of reversing the position shown in FIG. 1, the movement of the straight-lined supporting rods 4 moving only in longitudinal direction is indicated by the arrow 13. When simultaneously moving the supporting rods 4 in the same sense, the secured position is first relieved on account of the fact that the thrust supports 10 of the tongue rail 3 contacting the stock rail 1 is disengaged from the surfaces 9 extending in parallel relation to the supporting rod 4, whereupon on further shifting the supporting rods 4 in direction of the arrow 13 the wedge surfaces 8 of the thrust supports 7 associated to the second tongue rail 3 come in engagement with the thrust supports 10 of this tongue rail and effect reversal of the switch under the action of the track rods 11. Locking in the end position is there again effected by the engagement of the surfaces 9 on the thrust supports 10 as soon as the supporting rods 4 assume the end position. For the purpose of taking in consideration the curvature behavior of the tongue rails in spite of the supporting rods 4 being arranged in essentially parallel relation to the stock rail 1, the thrust supports 10 provided on the tongue rail 3 and cooperating with the thrust supports 7 are given different dimensions, and the thrust supports 7 comprise in correspondence with the curvature behavior of the tongue rails 3 wedge surfaces 8 of different inclination and supporting surfaces 9, extending in parallel relation to the supporting rods 4, at a varying distance from the supporting rods 4.

When correspondingly arranging the thrust supports 7 on the supporting rods 4, also a movement of the supporting rods in the opposite sense is easily conceiveable for reversing and locking the tongue rails. For the purpose of reducing the friction of the thrust supports 10 on the wedge surfaces 8 during the reversing operation, there can, for example, be provided rollers within the area of the contacting surface of the thrust supports 10. Wedge surface shapes deviating from a straight-lined wedge surface 8 may be selected for easy rolling movement of such rollers. Furthermore, the thrust supports 10 may, at least over a partial area, be chamferred to have an inclination corresponding to the thrust support cooperating therewith.

Figure 2:
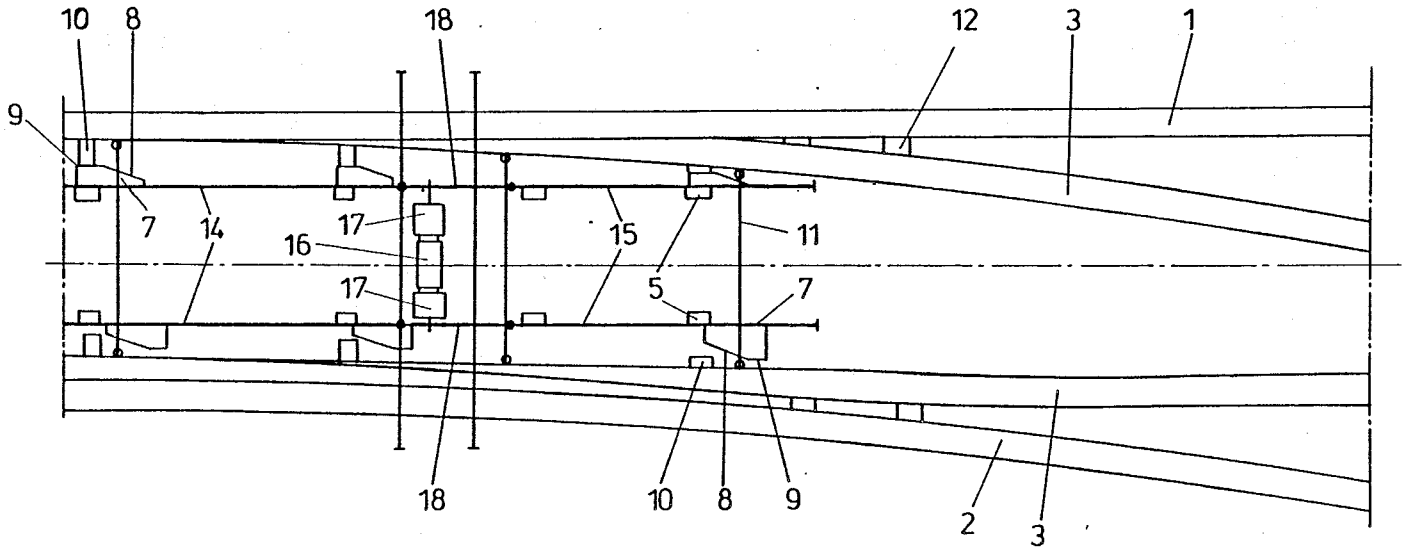
FIG. 2 shows another embodiment of an inventive reversing device for the movable tongue rails of a switch.

In the representation according to FIG. 2, there are maintained the reference numerals of FIG. 1 for identical constructional parts. For the purpose of reversing the tongue rails 3, there are again provided supporting rods extending essentially in longitudinal direction of the stock rail 1. These supporting rods are subdivided in the representation according to FIG. 2 and the paths of the supporting rods are designated by the reference numerals 14 and 15, respectively. On the supporting rods 14, 15, there are again provided thrust supports 7 comprising wedge surfaces 8 and supporting surfaces 9 extending in essentially parallel relation to the longitudinal direction of the supporting rods 14, 15, said supporting surfaces 9 cooperating with thrust supports 10 for reversing the tongue rails and locking same in their respective position contacting the stock rails. In the embodiment according to FIG. 2, the drive means is formed of a motor 16 being schematically indicated and being arranged approximately at the middle part of the length of the whole supporting rods 14, 15. There are further indicated gearings 17. Transformation of the rotating movement of the motor into translational movement of the supporting rods 14, 15 is, for example, effected via toothed racks 18 by means of which the supporting rods 14, 15 are connected one with the other.

In place of the drive means shown in the FIGS. 1 and 2, there can be provided other known drive means. In place of the drive means 6 of FIG. 1, there is, for example, conceiveable a common drive means for a translational movement of the supporting rods 4, in which drive means the supporting rods are coupled one with the other. It is further conceiveable to use angle levers for transforming an adjusting movement of a drive means into an essentially translational movement of the supporting rods. These angle levers comprise, in a manner known per se, suitable connecting link guides or recesses. These angle levers can also be provided on rotatable discs or the like, which may, for example, be coupled with a usual switch reversing device being arranged in transverse relation to the longitudinal direction of the rails.

Figure 3:
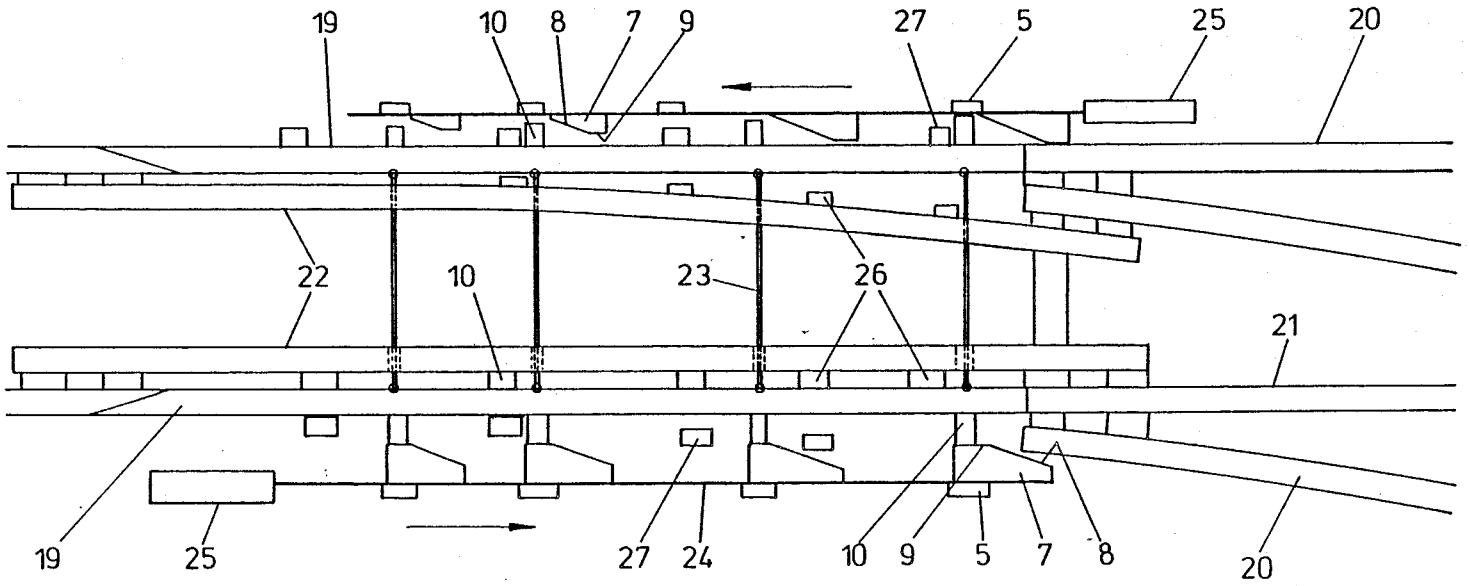
FIG. 3 shows an inventive reversing device for the movable stock rails of a switch.

In FIG. 3, there is shown a reversing device for a monorail deflecting device comprising a movable stock rail. In this case, the movable sections of the stock rail are designated by the reference numeral 19 and the rigid intermediate rails being fixed to sleepers, or, respectively, base plates (not shown in detail), are designated by the reference numerals 20 and 21. The intermediate rails 20 represent parts of the stock rails, and that the intermediate rails 21 are to be considered as parts of the tongue rails, as compared with the FIGS. 1 and 2. There are further shown connecting bands 22. The movable sections of the stock rails 19 are connected via connecting rods 23 similar to the connecting rods 11 of the FIGS. 1 and 2. For the purpose of reversing the stock rails 19 and locking same, respectively, there are again provided supporting rods 24 arranged in a longitudinal direction, said supporting rods, being supported and guided in schematically indicated guide means, being again designated by the reference numeral 5. Electric lifting motors or hydraulic cylinder-piston-aggregates 25 are again provided as the drive means. The supporting rods 24 comprise again thrust supports 7 having wedge surfaces 8 and supporting surfaces 9 extending in an essentially parallel relation to the longitudinal direction of the supporting rods 24. In this case, the thrust supports 10 of the movable parts of the stock rails 19 and cooperating with the thrust supports 7 are, like the individual thrust supports, of mutually different design in correspondence with the curvature behavior of the stock rail 19.

For the purpose of supporting the existing end position of the movable stock rails 19, there are further provided, in a manner not shown in detail, stop members 26 on the intermediate rails 22 and stop members 27 on the sleepers or supporting plate. When reversing the switch, the drive means 25 are controlled such that at first the lock achieved by the cooperation of the thrust supports 10 with the supporting surfaces 9 is released, whereupon reversing of the stock rails into the other end position is effected by the cooperation of the wedge surfaces 8 with the thrust supports 10 when shifting the supporting rods 24. When reversing such movable stock rails; there are transmitted high forces on the stock rail, so that the supporting rods 24 have to be given a correspondingly stable and strong construction and must be provided with a corresponding drive means.

Figure 4:
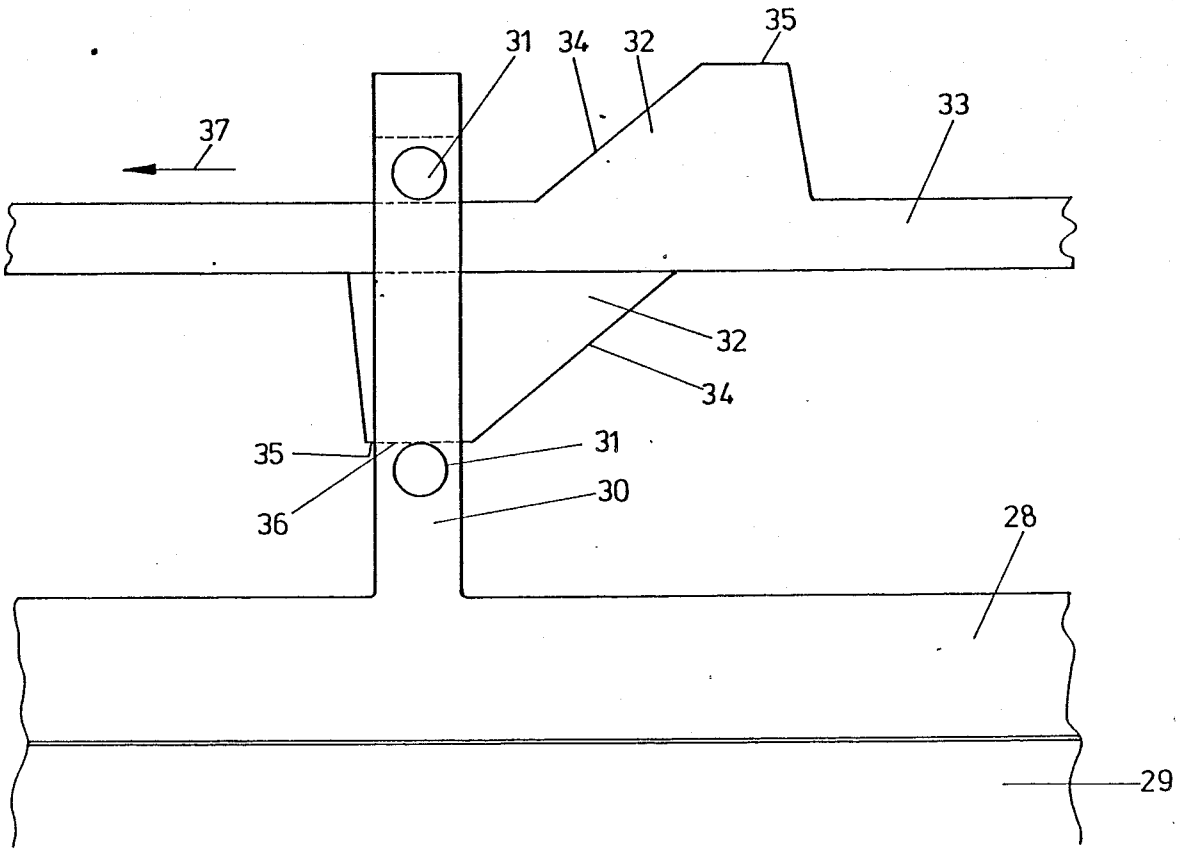
FIG. 4 shows a first embodiment of a supporting rod comprising thrust supports arranged at both sides of a supporting rod, and this in an enlarged scale as compared with the previous Figures.

In FIG. 4 there is shown, in an enlarged scale as compared with the previous figures, a tongue rail 28 contacting a stock rail 29. A thrust support 30 is connected with the tongue rail 28 and has bearingly supported therein rollers 31 cooperating with thrust supports 32 of a movable supporting rod 33, being movable only in longitudinal direction of the rail. The thrust supports 32 comprise, again, inclined wedge surfaces 34 as well as supporting surfaces 35 extending in an essentially parallel relation to the longitudinal direction of the supporting rod 33. In the position shown in FIG. 4, locking of the tongue rail is effected by the cooperation of the supporting surface 35 facing the rail with an engaging surface 36 provided within the plane of the roller 31. For the purpose of opening or, respectively, reversing the tongue rail, there are, when moving the supporting rod 33 in direction of the arrow 37, at first disengaged the mutually contacting surfaces 35 and 36, whereupon subsequently the roller 31 located at a greater distance from the tongue rail 28 comes in engagement with the outwardly located wedge surface 34 and thus draws the tongue rail 28 off the stock rail 29. For the purpose of supporting the tongue rail 28 over its whole length, there are, in a manner analogous to the previous figures, arranged on the supporting rod 33 and in longitudinal direction thereof several thrust supports. In such an embodiment of a twin-arrangement of thrust supports, coupling of the tongue rails as shown in FIGS. 1 and 2 can be omitted, because not only reversal and locking is effected via the thrust supports, but also opening of the corresponding tongue rail is effected by the thrust support arranged at the other side of the supporting rod. If the supporting rod has a corresponding stability and if a correspondingly powerful drive means is provided, an arrangement comprising a support rod having thrust supports 32 at both of its sides can also cooperate with a connecting rod or, respectively, track rod between the tongue rails, so that one can do with one single supporting rod for reversing both tongue rails. For this purpose, the thrust support 30 shown in FIG. 4 and being connected with the tongue rail 28 is designed as a tongue connection being, for example, designated in FIG. 1 by the reference numeral 11.

Figure 5:
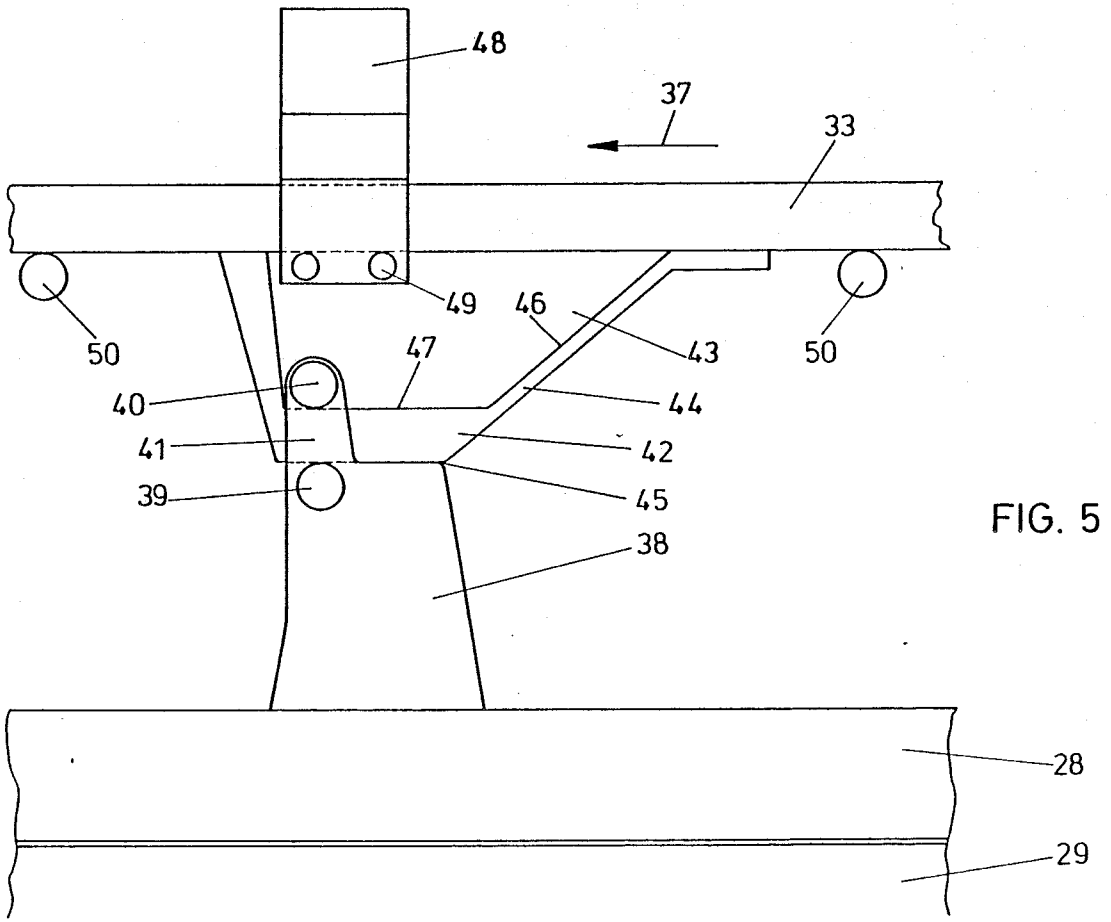
FIG. 5 shows another embodiment of a twin-arrangement of thrust supports in a representation analoguous to that of FIG. 4.

In the arrangement according to FIG. 5, the tongue rail 28 is again shown in its position contacting a stock rail 29 and is connected with the thrust support 38. The thrust support 38 has rollers 39 and 40 which are rotatably supported within a protrusion 41 of the thrust support 38 and embrace a ledge 42 being connected with a thrust support 43 in its turn being connected with the supporting rod 33. The ledge 42, which, for example, extends outward of the plane of the supporting rod 33 has a first wedge surface 44 passing over into a first supporting surface 45 extending essentially in parallel relation to the longitudinal direction of the supporting rod 33 and cooperating with the roller 39, and has as well a second wedge surface or, respectively, inclined surface 46 passing over into a second supporting surface 47. When moving the supporting rod 33 in direction of the arrow 37 for the purpose of opening or, respectively, reversing the tongue rail 28, there is first disengaged the roller 39 from the supporting surface 45, whereupon the tongue rail 28 is lifted off from the stock rail 29 on account of the cooperation of the roller 40 with the second wedge surface 46 of the ledge. For the purpose of guiding the supporting rod 33, there is provided a guide means 48 being connected with sleepers not being shown in detail. The guide means 48 comprise guide rollers 49 for frictionless sliding movement of the supporting rod 33. Further guide rollers 50 are indicated which improve the guiding effect. Similar to the arrangement according to FIG. 4, one can do without connecting rods or, respectively, track rods between the tongue rails if, in the shown embodiment of a supporting rod comprising thrust supports, such a thrust support is associated with each tongue rail. One can, however, also do with one single such supporting rod for reversing the switch if a connection between both tongue rails is provided, because, in the embodiment shown in FIG. 5, a reversing movement as well as a simultaneous opening movement is obtained when shifting the supporting rod on account of the design and arrangement of the wedge surfaces and supporting surfaces.

The use of reversing devices according to the invention for a railway switch comprising supporting rods extending in longitudinal direction of the rail and being only translationally moved is of particular advantage for switches extending along a great arc, in which switches would have to be provided several locks of usual construction. On account of the reversing device according to the invention, one can do, for the reversing operation and for locking purposes, with supporting rods associated to movable rails and it is possible to obtain in a simple manner a definite support for and adjustment of the curvature of the movable parts of the switch by a desired number of correspondingly designed thrust supports on these supporting rods. The thrust supports cooperate with correspondingly sized stop members on the movable switch parts. There result further the advantages that no locking springs are required for separate required locks, that no component parts extend into the railway bed and that, when using drive means of the type shown in the FIGS. 1 to 3, no lateral drive means and supports therefor must be provided. On account of reversing the movable rail parts and locking their end positions being effected by means of the thrust supports comprising the wedge surfaces and the supporting surfaces extending in essentially parallel relation to the longitudinal direction of the supporting rods, it becomes possible to reduce to a minimum the tongue opening and to always warrant the narrowest passage. When using the reversing device for reversing a tongue arrangement of the type shown in the FIGS. 1 and 2, the tongue is clamped between the thrust supports under the action of the supporting rods in case of a suitable arrangement of the stop members on the tongue rails, whereby any twist or torsion of the tongue rails is prevented and correct contact of the tongue rails at each location and the exactness of the shape of the travelling edge is always warranted.

What is claimed is:

1. A reversing device for a railway switch, comprising:

a first pair of laterally-spaced fixed rails at one end of a deflection area;

two alternatively useful second pairs of laterally-spaced fixed rails at an opposite end of said deflection area, respective ones of said rails in said two pairs converging towards one another towards said deflection area;

said first pair of fixed rails being in longitudinal alignment with respective rails of one of said second pairs of fixed rails for providing a substantially straight longitudinal path through the railway switch and with respective rails of the other of said second pairs of fixed rails for providing a curved path through the railway switch;

two said rails at a same end of said deflection area having corresponding switchable portions which are fixed at said same end of said deflection area to provide continuations of respective ones of said rails, and which are supported for coordinated lateral deflection along the lengths thereof between one position in which said switchable portions are disposed to provide continuity through the railway switch along said substantially straight path and another position in which said switchable portions are disposed to provide continuity through the railway switch along said curved path;

said rails being supported on a fixed base;

at least one longitudinally elongated supporting rod supported on said fixed base by guide means so as to be aligned with said substantially straight path and disposed for longitudinal movement forwards and rearwards along said substantially straight path;

means for moving said at least one longitudinally elongated supporting rod substantially longitudinally forwards and rearwards along said substantially straight path;

each of said switchable portions of said rails being provided with a plurality of longitudinally-spaced, laterally-projecting first thrust supports;

said at least one supporting rod being provided with two sets of longitudinally-spaced, laterally-projecting second thrust supports;

each first thrust support having a laterally-facing thrust support surface means arranged to engage a respective laterally-facing thrust support surface means of a respective second thrust support upon longitudinal movement of said at least one elongated support rod to a selected position;

said thrust support surface means of one of said first and second thrust supports comprising a wedge-shaped ramp surface adjoining a main surface oriented substantially parallel to said substantially straight path;

said thrust support surface means being disposed and oriented such that when corresponding thrust support surface means of said first and second supports are not in engagement and said at least one longitudinally-elongated supporting rod is moved longitudinally by said moving means to cause engagement, said wedge-shaped ramp surfaces of the thrust support surface means of one of said first and second thrust supports first engages, and cams against the thrust support surface means of the other of said first and second thrust supports, thereby deflecting the respective said switchable portion of said rails from alignment in one of said paths into alignment in the other of said paths, and further movement of said at least one longitudinally-elongated supporting rod causes the main surfaces of the thrust support surface means of said one of said first and second thrust supports to engage against the thrust support means of the other of said first and second thrust supports, thereby holding the respective switchable portion of said rails in alignment with the other of said paths, and reverse movement of said at least one longitudinally-elongated supporting rod progressively eliminates holding of the respective switchable portion of said rails in alignment with said other of said paths and removes camming action therefrom by said wedge-shaped ramp surfaces, permitting the respective switchable portion to return to alignment with said one of said paths.

2. The reversing device of claim 1, wherein:

at least one of said support surface means is provided with roller means rollable about a substantially vertical axis.

3. The reversing device of claim 1, wherein:

there are at least three said first thrust supports provided on each of said switchable portions of said rails.

4. The reversing device of claim 3, wherein:

said at least one longitudinally-elongated supporting rod is constituted by one longitudinally-elongated supporting rod having two sets of three said second thrust support supports provided thereon, staggered out of lateral alignment with one another, said wedge-shaped ramp surfaces being provided on said second thrust supports with said wedge-shaped ramp surfaces in one said set facing towards and opposite longitudinal direction than those in the other said set.

5. The reversing device of claim 3, wherein:

on each said set of thrust supports which has said wedge-shaped ramp surfaces, said wedge-shaped ramp surfaces have progressively steeper angles of oblique inclination from along the respective said set.

6. The reversing device of claim 3, wherein:

in each set of first thrust supports, the respective thrust supports are of progressively greater lateral extent transversally of said substantially straight path.

7. The reversing device of claim 3, wherein:

in each set of second thrust supports, the respective thrust supports are of progressively greater lateral extent transversally of said substantially straight path.

8. The reversing device of claim 1, wherein:

one of said first and second thrust supports comprise cranked ledges having laterally opposite surfaces, and the other of said first and second thrust supports comprise roller means arranged to engage both said laterally opposite surfaces.

9. The reversing device of claim 1, further including:

stop means mounted on said fixed base and positioned for engagement with respective of said switchable portions of said rails for defining positioning thereof when not deflected by engagement between respective surfaces of respective of said first and second thrust supports.

10. The reversing device of claim 1, further including:

a plurality of longitudinally-spaced track rods laterally interconnecting said switchable portions of said rails for coordinating lateral deflection thereof.

11. The reversing device of claim 1, wherein:

said at least one longitudinally elongated supporting rod comprises two said rods, and said moving means comprises a drive means for each said rod.

12. The reversing device of claim 1, wherein:

said at least one longitudinally-elongated supporting rod comprises two said rods, and said moving means comprises one drive means for both said rods and drive transmitting means operatively connecting said drive means with both of said rods.

* * * * *